US011251554B1

(12) United States Patent
Tan et al.

(10) Patent No.: US 11,251,554 B1
(45) Date of Patent: Feb. 15, 2022

(54) PCIE/SAS FEMALE CONNECTOR

(71) Applicant: AMPHENOL EAST ASIA ELECTRONIC TECHNOLOGY (SHEN ZHEN) CO., LTD., Shen Zhen (CN)

(72) Inventors: Yan-Bin Tan, Shen Zhen (CN); Xiang Wang, Shen Zhen (CN); Lei Liao, Shen Zhen (CN); Wei Luo, Shen Zhen (CN)

(73) Assignee: AMPHENOL EAST ASIA ELECTRONIC TECHNOLOGY (SHEN ZHEN) CO., LTD., Shen Zhen (CN)

( * ) Notice: Subject to any disclaimer, the term of this patent is extended or adjusted under 35 U.S.C. 154(b) by 0 days.

(21) Appl. No.: 17/016,009

(22) Filed: Sep. 9, 2020

(51) Int. Cl.
*H01R 12/72* (2011.01)
*H01R 12/71* (2011.01)
*H01R 13/10* (2006.01)

(52) U.S. Cl.
CPC ..... *H01R 12/727* (2013.01); *H01R 12/712* (2013.01); *H01R 12/716* (2013.01); *H01R 12/71* (2013.01); *H01R 12/714* (2013.01); *H01R 12/721* (2013.01); *H01R 13/10* (2013.01)

(58) Field of Classification Search
CPC .. H01R 12/727; H01R 12/712; H01R 12/716; H01R 12/714; H01R 12/71; H01R 13/10; H01R 12/721
USPC ..... 439/637
See application file for complete search history.

(56) References Cited

U.S. PATENT DOCUMENTS 8,702,451 B2 * 4/2014 Luo ..... H01R 12/725 439/607.28

* cited by examiner

*Primary Examiner* — Abdullah A Riyami
*Assistant Examiner* — Justin M Kratt
(74) *Attorney, Agent, or Firm* — Muncy, Geissler, Olds and Lowe, P.C.

(57) ABSTRACT

A PCIe/SAS female connector includes a frame body, a terminal assembly, and a cover member; the frame body including a groove disposed on an end thereof; the terminal assembly including a Serial Advanced Technology Attachment (SATA) 7 pin signal and grounding terminal inserted in the frame body and having a head portion and a foot. When the SATA 7 pin signal and grounding terminal is inserted in the frame body, the head portion is in the groove. The cover member includes an elastic plate and a foot; the elastic plate disposed on the head portion of the cover member. When the PCIe/SAS female connector is engaged with a male connector, the head portion of the SATA 7 pin signal and grounding terminal contacts the elastic plate of the cover member. The foot of the SATA 7 pin signal and grounding terminal and the foot of the cover member are welded in an identical Printed Circuit Board (PCB) pad.

4 Claims, 3 Drawing Sheets

PCIE/SAS FEMALE CONNECTOR

BACKGROUND OF THE INVENTION

1. Field of the Invention

The present invention relates to connectors, and more particularly, to a PCIe/SAS female connector.

2. Description of the Related Art

With continually growing data storage amounts, the requirement for the transmission rate gradually increases. Also, the application range thereof expands accordingly as well. It is desirable for a single product to fulfill several connectors with high frequency performance simultaneously.

A conventional Peripheral Component Interconnect Express (PCIe)/Serial Attached SCSI (SAS) female connector, which can also be called PCIe/SAS female connector is able to reach a 32 Gbps transmission rate, which is mainly applied to a high speed transmission system for enterprise class servers. However, when such a connector is engaged with outer device, the engagement end of the terminal thereof is easily pressed to be warped, so that the pins are bent, causing negative effects upon the conductivity and service life of the pins.

SUMMARY OF THE INVENTION

For improving the issues above, a PCIe/SAS female connector is disclosed. With an optimized structure, the female connector is prevented from having a bent pin condition after a long period of engagement.

For achieving the aforementioned objectives, a PCIe/SAS female connector is provided, comprising: a frame body, a terminal assembly, and a cover member; the frame body comprising a groove disposed on an engagement end of the frame body; the terminal assembly inserted in the frame body and comprising a Serial Attached SCSI (SAS) 6 pin signal terminal, a Serial Advanced Technology Attachment (SATA) 7 pin signal and grounding terminal, a SATA 15 pin power terminal, and a SAS 40 pin signal and grounding terminal; the SATA 7 pin signal and grounding terminal comprising a head portion and a foot; when the SATA 7 pin signal and grounding terminal being inserted in the frame body, the head portion being positioned in the groove; the cover member being formed in a plate shape and installed on a lateral side of the frame body in which the SATA 7 pin signal and grounding terminal is inserted; the cover member comprising an elastic plate and a foot; the elastic plate being disposed on the head portion of the cover member; when the PCIe/SAS female connector is engaged with a male connector, the head portion of the SATA 7 pin signal and grounding terminal contacts the elastic plate of the cover member; the foot of the SATA 7 pin signal and grounding terminal and the foot of the cover member being welded in an identical Printed Circuit Board (PCB) pad.

Preferably, the frame body of the PCIe/SAS female connector is formed of a plastic material.

Preferably, when the PCIe/SAS female connector is engaged with a male connector, the head portion is positioned in the groove.

Preferably, the PCIe/SAS female connector comprises a fix plate disposed on a contact end of the frame body contacting the PCB pad.

With such a configuration, compared with the prior art, the present invention resolves the issue of the pins of the terminal of the conventional connector are easily bent when the female connector is engaged with a male connector. The SATA 7 pin signal and grounding terminal contacts the elastic plate and the pins of the cover member, such that the product simultaneously fulfills Peripheral Component Interconnect Express (PCIe) Gen5, U.2, and U.3 types of high frequency performance requirements. The head portion of the SATA 7 pin signal and grounding terminal is hidden in the groove, so as to prevent the pins of the terminal from bending during the engagement of the female connector and the male connector.

DETAILED DESCRIPTION OF THE INVENTION

The present invention will be described in detail below in conjunction with FIG. 1 to FIG. 4 and specific embodiments, but the drawings and description are not intended to limit the present invention.

Embodiment 1

Figure 1:
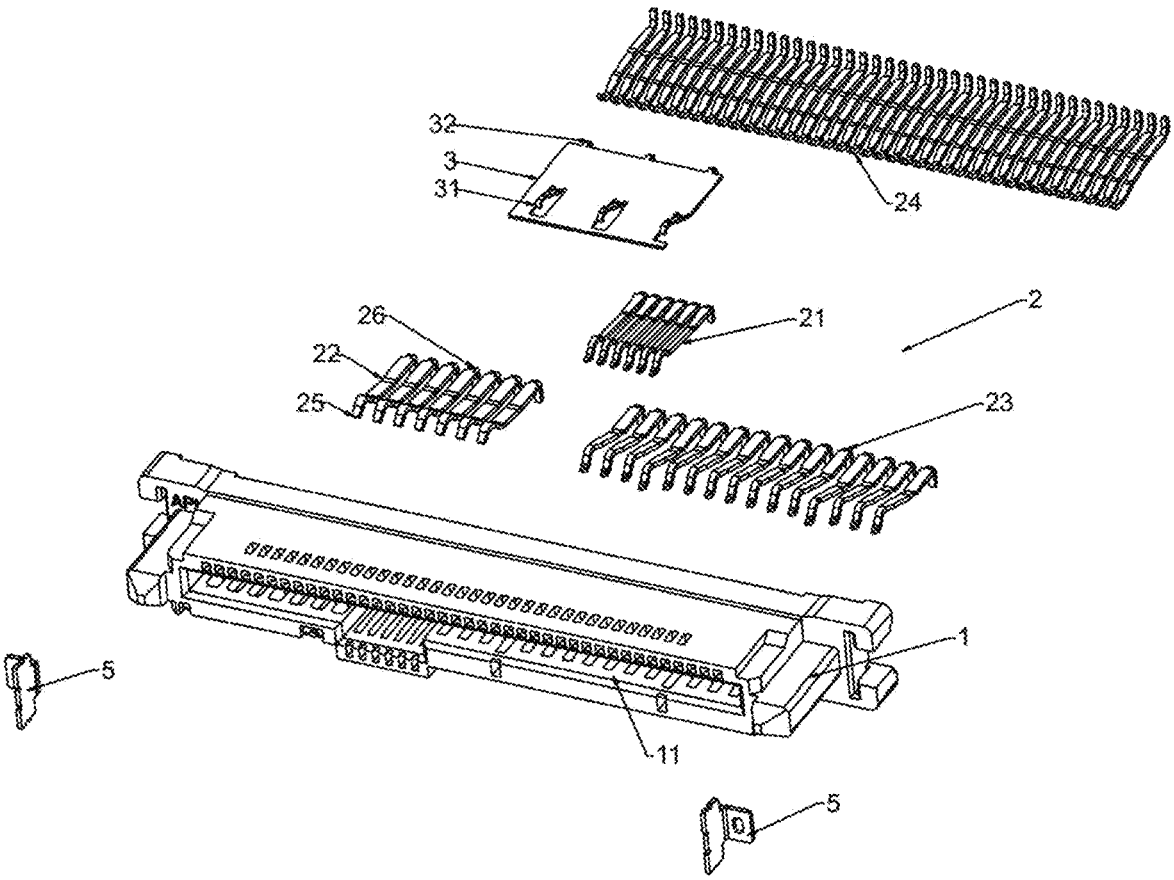
FIG. 1 is an exploded view of the PCIe/SAS female connector in accordance with an embodiment of the present invention.
Figure 2:
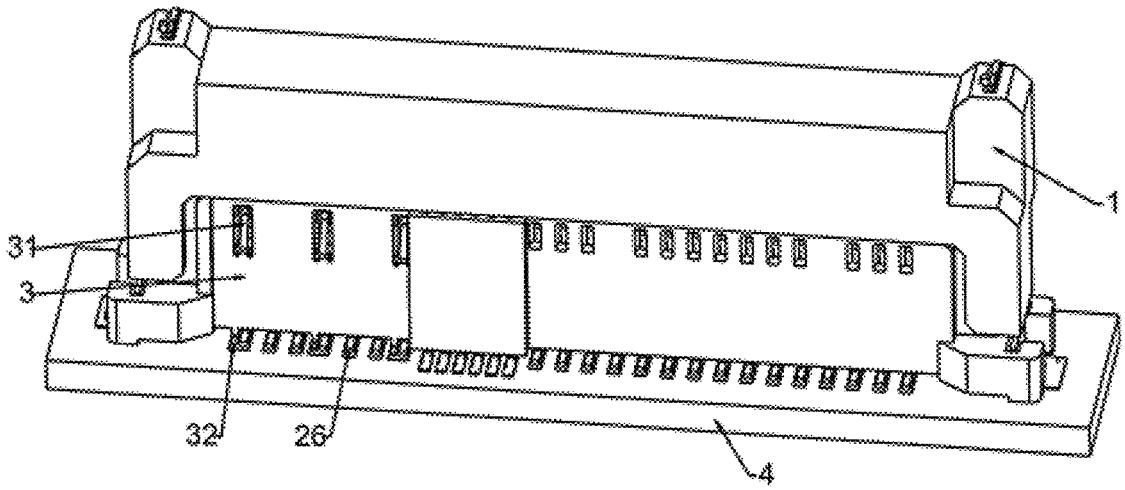
FIG. 2 is a perspective view of the PCIe/SAS female connector in accordance with an embodiment of the present invention.

Referring to FIG. 1 and FIG. 2, the PCIe/SAS female connector comprises a frame body 1, a terminal assembly 2, and a cover member 3.

The frame body 1 comprises a groove 11 disposed on an engagement end of the frame body 1.

The terminal assembly 2 is inserted in the frame body 1 and comprising a Serial Attached SCSI (SAS) 6 pin signal terminal 21, a Serial Advanced Technology Attachment (SATA) 7 pin signal and grounding terminal 22, a SATA 15 pin power terminal 23, and a SAS 40 pin signal and grounding terminal 24.

The SATA 7 pin signal and grounding terminal 22 comprises a head portion 25 and a foot 26. When the SATA 7 pin signal and grounding terminal 22 is inserted in the frame body 1, the head portion 25 is positioned in the groove 11.

The cover member 3 is formed in a plate shape and installed on a lateral side of the frame body 1 in which the SATA 7 pin signal and grounding terminal 22 is inserted The cover member 3 comprises an elastic plate 31 and a foot 32. The elastic plate 31 is disposed on the head portion of the cover member 3.

Figure 3:
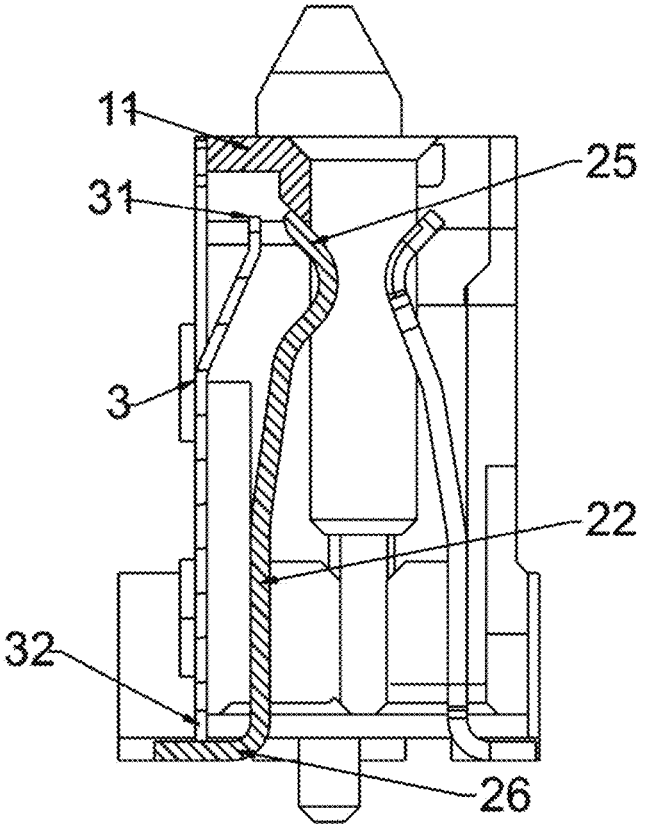
FIG. 3 is a side sectional view of the PCIe/SAS female connector in accordance with an embodiment of the present invention.
Figure 4:
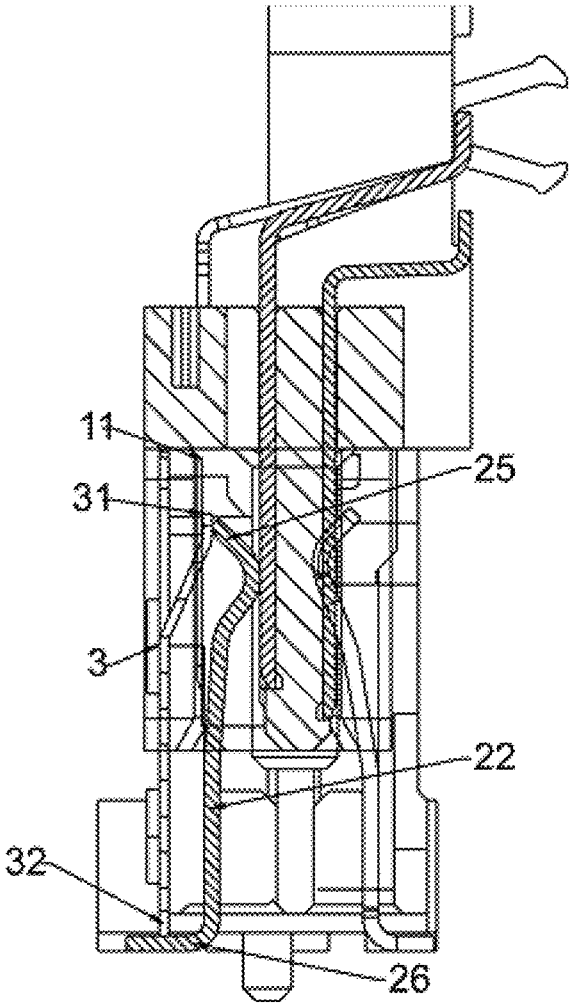
FIG. 4 is a side sectional view illustrating the PCIe/SAS female connector engaged with a male connector.

Referring to FIG. 3 and FIG. 4, when the PCIe/SAS female connector is engaged with a male connector, the head portion 25 of the SATA 7 pin signal and grounding terminal 22 contacts the elastic plate 31 of the cover member 3. Referring to FIG. 2 and FIG. 4, the foot 26 of the SATA 7 pin signal and grounding terminal 22 and the foot 32 of the cover member 3 are welded in an identical Printed Circuit Board (PCB) Pad 4.

The PCIe/SAS female connector comprises a fix plate 5 disposed on a contact end of the frame body 1 contacting the PCB pad 4.

Embodiment 2

Based on embodiment 1, referring to FIG. 3 and FIG. 4, the frame body 1 of the PCIe/SAS female connector is formed of a plastic material. When the PCIe/SAS female connector is engaged with a male connector, the head portion 25 is positioned in the groove 11.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A Peripheral Component Interconnect Express/Serial Attached SCSI (PCIe/SAS) female connector is provided, comprising: a frame body, a terminal assembly, and a cover member;

the frame body comprising a groove disposed on an engagement end of the frame body;

the terminal assembly comprising a Serial Attached SCSI (SAS) 6 pin signal terminal, a Serial Advanced Technology Attachment (SATA) SATA 7 pin signal and grounding terminal, with all inserted in the frame body;

the SATA 7 pin signal and grounding terminal comprising a head portion and a foot; when the SATA 7 pin signal and grounding terminal is inserted in the frame body, the head portion is positioned in the groove;

the cover member being formed in a plate shape and installed on a lateral side of the frame body in which the SATA 7 pin signal and grounding terminal is inserted;

the cover member comprising an elastic plate and a foot; the elastic plate being disposed on the head portion of the cover member;

when the PCIe/SAS female connector is engaged with a male connector, the head portion of the SATA 7 pin signal and grounding terminal contacts the elastic plate of the cover member; the foot of the SATA 7 pin signal and grounding terminal and the foot of the cover member being welded in an identical Printed Circuit Board (PCB) pad.

2. The PCIe/SAS female connector of claim 1, wherein the frame body of the PCIe/SAS female connector is formed of a plastic material.

3. The PCIe/SAS female connector of claim 1, wherein when the PCIe/SAS female connector is engaged with a male connector, the head portion is positioned in the groove.

4. The PCIe/SAS female connector of claim 1, further comprising a fix plate disposed on a contact end of the frame body contacting the PCB pad.

* * * * *